US005479951A

United States Patent [19]

Denebeim

[11] Patent Number: 5,479,951

[45] Date of Patent: Jan. 2, 1996

[54] BENDABLE, EXTENDABLE HAIRBRUSH WITH REMOVABLE BRUSH HEAD

[76] Inventor: Sabrina S. Denebeim, 260 Avila St., San Francisco, Calif. 94123

[21] Appl. No.: 222,696

[22] Filed: Apr. 4, 1994

[51] Int. Cl.[6] ..... A45D 2/00; A45D 1/20; A46B 5/02

[52] U.S. Cl. ..... 132/265; 132/233; 132/120; 15/144.4; 15/207.2; 15/176.1

[58] Field of Search ..... 119/94; 132/265, 132/150, 120, 160, 233, 218; 15/144.4, 145, 143.1, 144.3, 207.7, 176.1, 176.2, 176.3, 176.4, 176.5, 176.6; D4/138, 136, 127, 128

[56] References Cited

U.S. PATENT DOCUMENTS

| | | | |
|---|---|---|---|
| D. 270,669 | 9/1983 | Cassai et al. | D28/7 |
| 1,796,001 | 3/1931 | Church . | |
| 2,160,618 | 5/1939 | Kreutzig | 132/120 |
| 2,192,408 | 3/1940 | Lux | 132/150 |
| 2,254,365 | 9/1941 | Griffith et al. | 15/172 |
| 2,761,163 | 9/1956 | Domino | 15/176 |
| 3,609,789 | 10/1971 | Slater | 15/104.94 |
| 3,967,630 | 7/1976 | Zuhlsdorff et al. | 132/262 |
| 3,987,805 | 10/1976 | Schuster | 132/262 |
| 4,192,325 | 3/1980 | Liedtke | 132/9 |
| 4,260,871 | 4/1981 | Nagelkerke | 219/222 |
| 4,358,660 | 11/1982 | Andis | 219/222 |
| 4,443,688 | 4/1984 | Andis | 219/222 |
| 4,500,939 | 2/1985 | Gueret | 15/207.2 |
| 4,561,456 | 12/1985 | Gueret | 15/207.2 |
| 4,576,190 | 3/1986 | Youssef | 132/89 |
| 4,605,023 | 8/1986 | Modin | 15/176.1 |
| 4,691,404 | 9/1987 | Tarrson et al. | 15/167 R |
| 4,712,266 | 12/1987 | Yamaki | 15/167.1 |
| 4,730,361 | 3/1988 | Koffler | 132/120 |
| 4,829,621 | 5/1989 | Phenegar | 15/172 |
| 5,033,155 | 7/1991 | Klotz | 15/144.4 |
| 5,191,907 | 3/1993 | Hirzel | 132/107 |
| 5,209,176 | 5/1993 | Pompei et al. | 15/144.4 |

FOREIGN PATENT DOCUMENTS

| | | | |
|---|---|---|---|
| 2482842 | 11/1981 | France | 132/266 |
| 2185930 | 8/1987 | United Kingdom . | |

*Primary Examiner*—John G. Weiss

*Attorney, Agent, or Firm*—Majestic, Parsons, Siebert & Hsue

[57] ABSTRACT

A combination hairbrush and hair curling system with a bendable, extendable handle and a removable brush head. The handle is constructed so that it can be bent to various positions and it will maintain the desired position until the user wishes to change the position. The extendable and bendable handle makes it easier to style the hair on difficult to reach areas of the head. The detachable brush heads are made in different sizes, shapes and styles for different kinds of hair styling operations. The brush heads are supplied in a variety of shapes, including cylindrical, concave/convex curved, flat/convex, flat/concave, ball-shaped and egg-shaped. The detachable brush heads can be detached from the handle ,and left in the hair as hair curlers. Each style of brush head can also be provided with gripping elements that are shaped like the hook portion of a hook and loop fastener and/or with bristles covering the entire brash head. The gripping elements may be used alone or in combination with standard brush bristles. The gripping elements provide additional grip between the brush and the hair during regular brushing and they provide a means for holding the brush heads in the hair without pins, clips or additional fasteners when they are used as hair curlers.

21 Claims, 11 Drawing Sheets

BENDABLE, EXTENDABLE HAIRBRUSH WITH REMOVABLE BRUSH HEAD

FIELD OF INVENTION

The present invention relates to a hair styling device. More particularly, it relates to a combination hairbrush and hair curling system with a bendable, extendable handle and a removable brush head.

BACKGROUND OF THE INVENTION

Hairbrushes and hair curlers are well known hair styling implements. Many people have a difficult time achieving optimum results with standard hairbrushes and hair curlers because it is difficult to style hard to reach areas of the head. For instance, simply brushing the hair on the top and back of the head requires awkward manipulations of the arm holding the hairbrush. For other operations, such as styling the hair with a blow dryer, the awkward positions must be held for several minutes, with one hand holding the styling brush and the other operating the blow dryer. For most of us, these manipulations can be difficult and tiring, but for people who are arthritic, elderly or handicapped, the problem is greatly compounded.

Professional hair dressers have no difficulty achieving excellent results because they can move around a person, reaching all areas of the client's head without awkward manipulations. It would be desirable, therefore, to provide a hair styling implement which will allow a person at home to achieve the results of a professional hair dresser without such awkward movements by making it easier for them to reach all areas of the head. Such a hair styling implement would make it easier for all people, young and old, to style their own hair.

SUMMARY OF THE INVENTION

In keeping with the foregoing discussion, an objective of the present invention is to provide a versatile hair styling device which is capable of functioning in several different modes of operation. In the first mode, the device functions as a standard short handled, rigid hairbrush. In the second mode, the handle of the hairbrush can be extended to allow styling of hard to reach areas of the head. In a third mode, the extended handle of the device can be bent to a variety of different positions for further assistance in styling hard to reach areas and for ease of performing a number of hair styling techniques.

In the fourth mode of operation, the head of the hairbrush is removable so that different types of styling heads can be interchanged on the device. Another objective of the invention is to use this interchangeable-head mode to provide a means for holding and applying hair curlers to a user's head. Another aspect of this objective is to provide special detachable styling heads for the brush that have gripping elements that hold them in the hair when they are used as hair curlers.

It is another objective of the present invention to provide a hair brush which can be compactly stored.

In accordance with these objectives, the present invention takes the form of a hairbrush with a telescoping extendable handle and multiple detachable brush heads. The handle is specially constructed so that it can be bent to various positions and it will maintain the desired position until the user wishes to change the position. The detachable brush heads are made in different sizes, shapes and styles for different kinds of hair styling operations. The brush heads are supplied in a variety of shapes, including cylindrical, concave/convex curved, ball-shaped and egg-shaped. Each style of brush head can also be provided with gripping elements that are shaped like the hook portion of a hook and loop fastener and/or bristles covering all sides of the brush head. The gripping elements may be used alone or in combination with standard brush bristles. The gripping elements provide additional grip between the brush and the hair during regular brushing and they provide a means for holding the brush heads in the hair without pins, clips or additional fasteners when they are used as hair curlers. The brush is made lightweight so that it is easy to use and the user's arms will not tire during use. The brush's flexibility allows the brush to be folded in half, thereby fitting more easily into a purse. Other objects and advantages of the invention will no doubt occur to those skilled in the art upon reading and understanding the following detailed description along with the accompanying drawings.

DETAILED DESCRIPTION OF THE INVENTION

Figure 1:
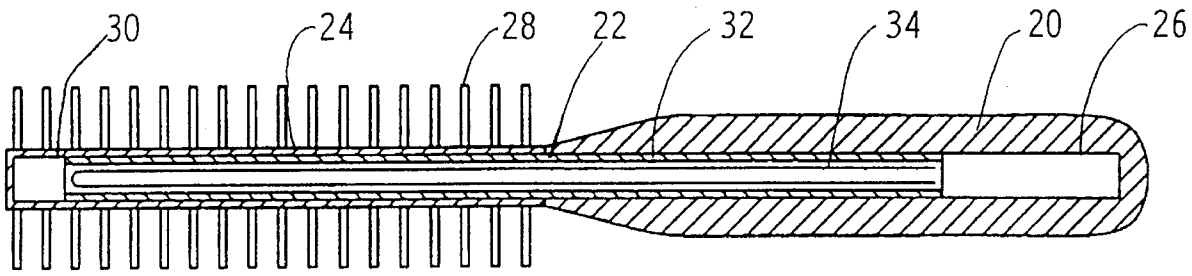
FIG. 1 shows a cross section of a first embodiment of the extendable, bendable hairbrush with the handle in the retracted position.
Figure 2:
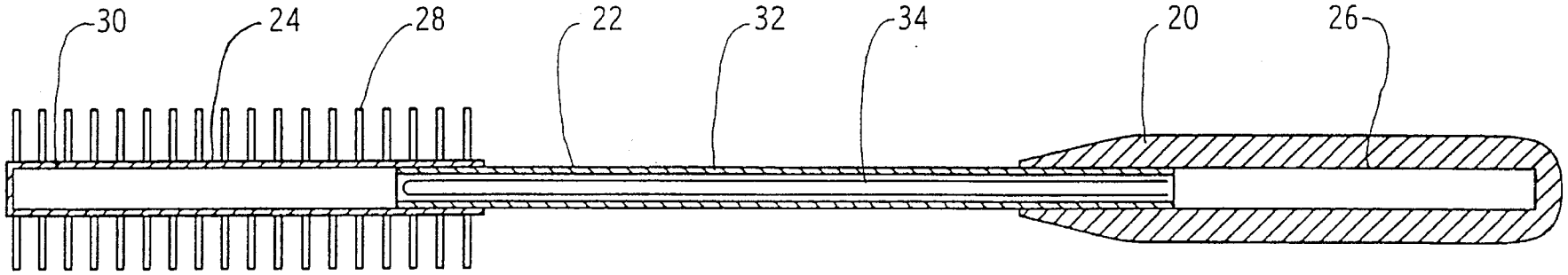
FIG. 2 shows the first embodiment with the handle in the extended position.
Figure 3:
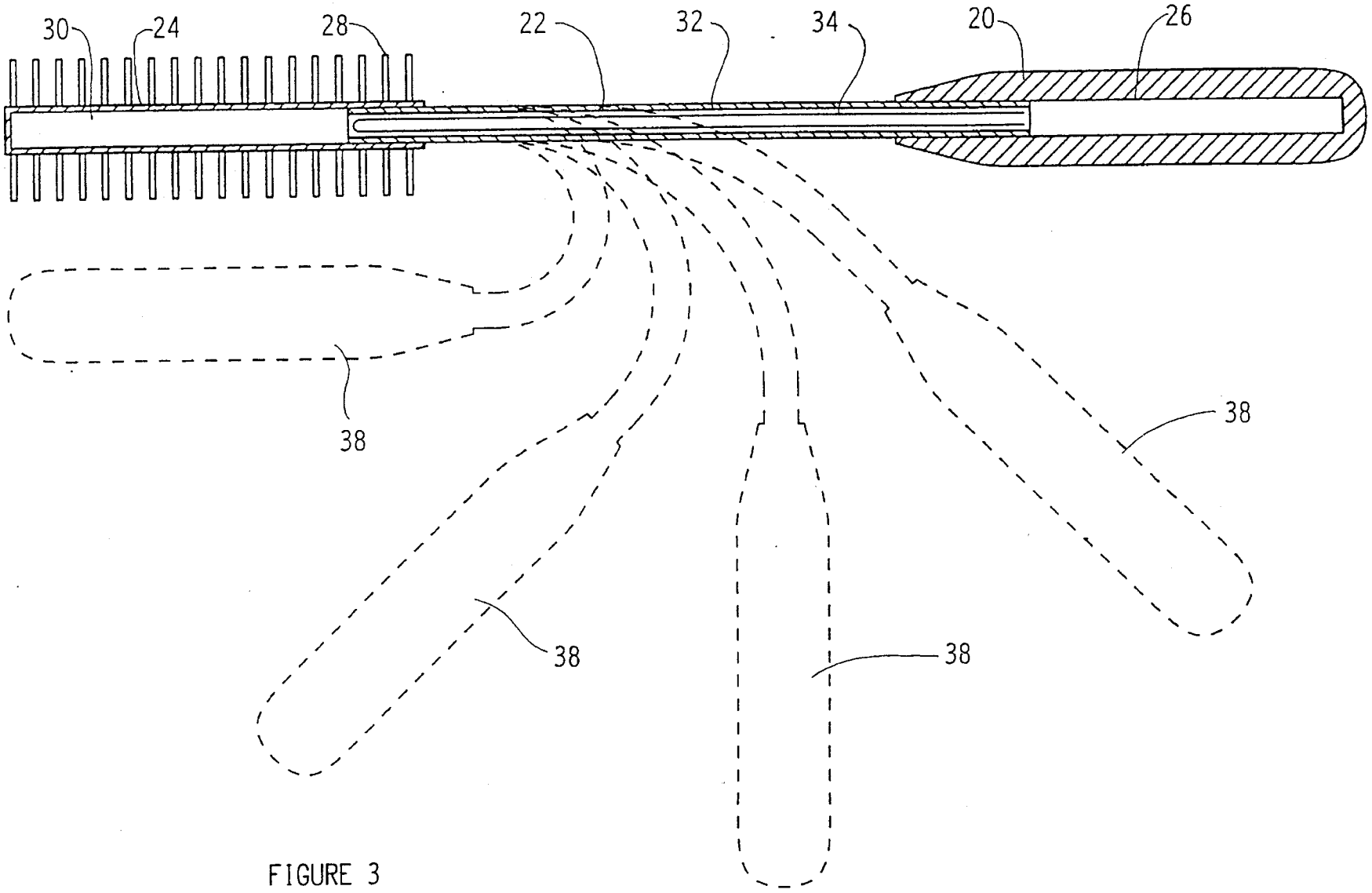
FIG. 3 shows various positions of the bendable handle of the first embodiment.

FIGS. 1–3 show a first embodiment of the present invention. FIG. 1 shows a cross section of this first embodiment of the hairbrush. This embodiment has a brush handle 20, a bendable extension 22 and a brush head 24. The brush handle 20 is preferably molded out of a thermoplastic material for economical manufacturing. If desired, the handle 20 may be made with a foam padded exterior surface for a more comfortable grip. The handle 20 has a hollow bore 26 which runs the length of the handle 20. The brush head 24 is shown in this embodiment as a cylindrical brush head with radially extending bristles 28. The brush head 24 also has a hollow bore 30 which extends through the length of the brush head 24. The bendable extension 22 is slidably received within the bore 26 of the brush handle 20 and within the bore 30 of the brush head 24 when the hairbrush is in the retracted position, as shown in FIG. 1. In this position, the hairbrush can be used like a standard short handled, rigid hairbrush.

FIG. 2 shows the hairbrush with the handle in the extended position. The brush head 24 has been pulled away from the brush handle 20 so that the bendable extension 22 is fully extended between the two. Friction between the bendable extension 22 and the brush head 24 and the brush handle 20 holds the hairbrush in this extended position. In this position, the extended handle helps the brush to reach hard to reach areas.

The bendable extension 22 is generally cylindrical in shape and is made of a flexible plastic tube 32 that contains a bending element 34. The bending element 34 should be made of a soft metal that is flexible enough that it can be easily bent to the desired position, yet rigid enough that it will hold the desired position after it has been bent. Suitable metals for the bending element 34 include, but are not limited to, mild steel, pure grades or alloys of aluminum and copper, lead or alloys of lead and tin or alloys of tin. These metals are suitable because, in their annealed state, they can be repeatedly bent to a desired shape and then restraightened without significant cold working of the material that would eventually cause it to stiffen or even break. The bending element 34 can be made so that it has a bias that allows it to bend easily in one plane, but resists bending in other planes. One geometry of a bending element 34 for creating this bending bias has a pair of bendable metal rods side-by-side or a single metal rod 36 bent into a hairpin configuration. Other geometries that exhibit a similar bending bias include a rectangular bar of metal which is wider in one direction than the other or a composite of metal lamina stacked together or a flat braid of wire.

FIG. 3 shows the hairbrush with the handle 20 and the bendable extension 22 bent to various configurations, as shown by the phantom lines 38. In the bent configuration, the hairbrush can easily be used to brush the hair on the back of the user's head without having to reach around behind the head with the arms. The bent handle can also be used for more easily achieving different hair styling techniques. With the handle bent upward, it is easier to style the hair into a flip or to style it toward the back of the head. With the handle bent downward, it is easy to style the hair so that it curves inward. Styles that require fullness on the top of the head can be quickly shaped by bending the hair across in the desired direction.

Figure 4:
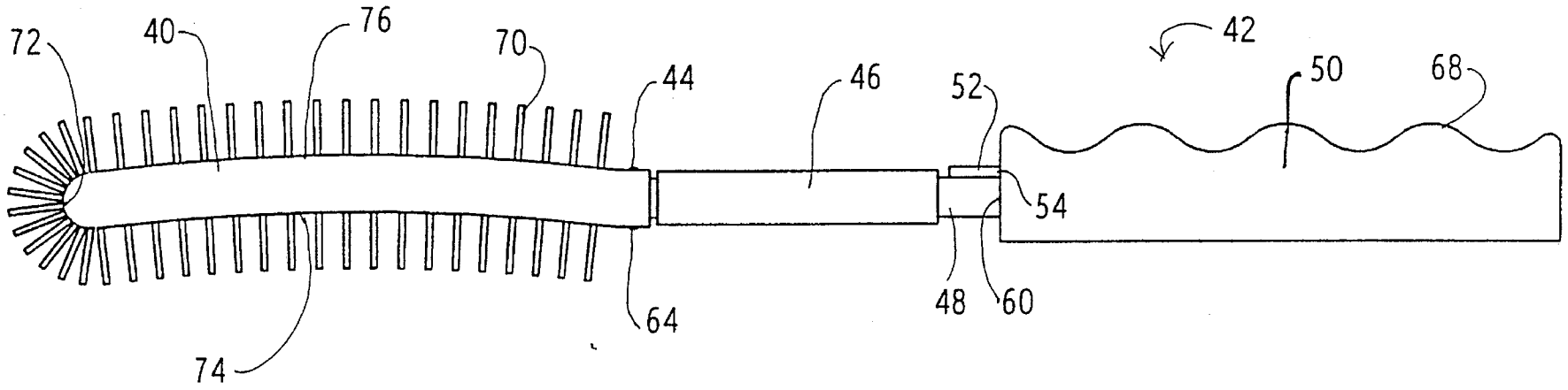
FIG. 4 shows a side view of a second embodiment of the extendable, bendable hairbrush with a detachably mounted brush head.

FIGS. 4–7 show a second embodiment of the present invention. FIG. 4 shows this second embodiment with the brush handle 42 in the retracted position. In this embodiment, the brush head 40 is mounted on the brush handle 42 with a removable connector 44. The type of removable connector 44 that is shown in FIGS. 4–7 is known as a bayonet connector. Other types of removable connectors that could be used include threaded connectors, tapered friction connectors and many more. The brush handle 42 is made up of a bendable section 46 and a telescoping extension 48 which is slidably received into a hollow bore 60 in the handle section 50. The handle 50 is locked against rotation in relation to the telescoping extension 48 by a key 52 on the telescoping extension 48 which slides within a keyway 54 in the handle section 46. The key 52 and the keyway 54 of the telescoping extension 48 can best be seen in the cross section of the side view in FIG. 6. The bendable section 46 has a bending element 56 within a flexible tube 58 similar to that described above in relation to the first embodiment. The construction details of the bendable section 46 and the bending element 56 can best be seen in the cross section of the top view in FIG. 7. The details of the bayonet connector 44 can also be seen in FIG. 7. A cylindrical plug 62 at the end of the bendable section 46 has a pin 64 inserted crosswise into the plug 62. The pin 64 is received into a pair of L-shaped slots 66 in the brush head 40 which lock the brush head 40 and the handle 42 together.

Figure 5:
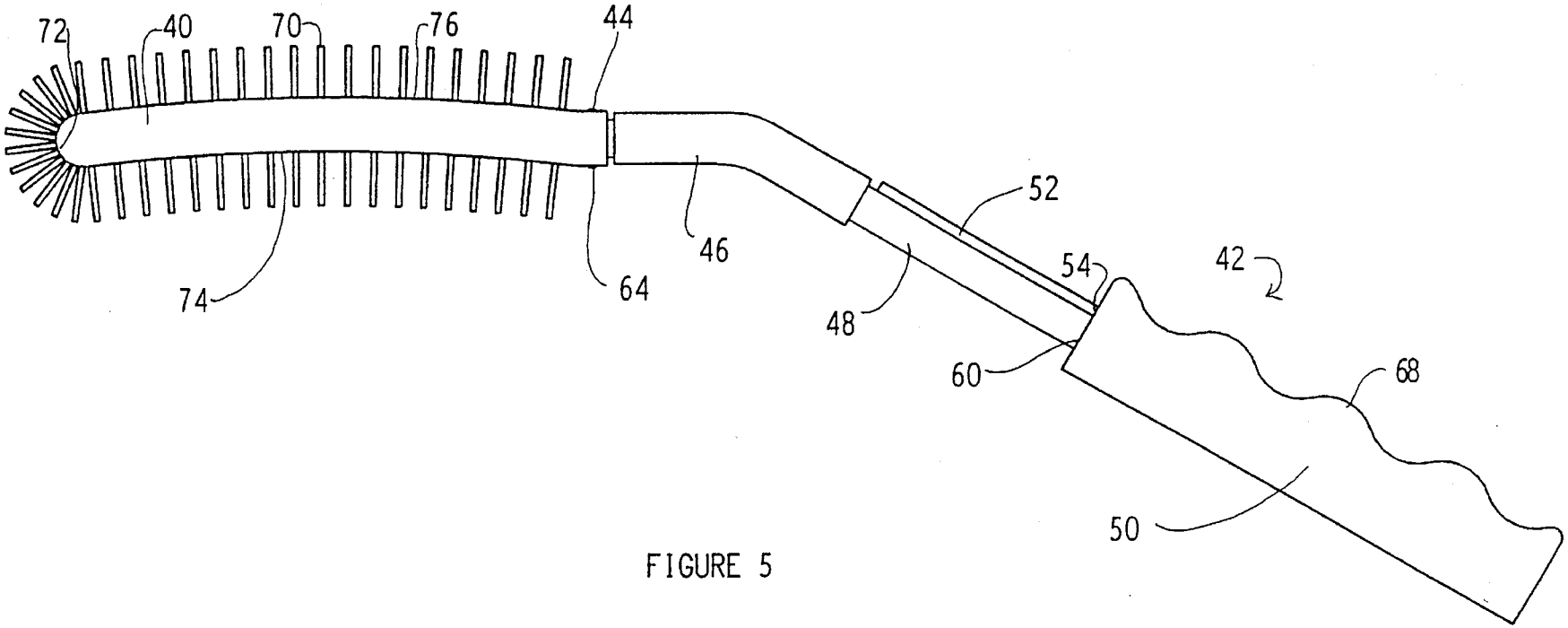
FIG. 5 shows the second embodiment in an extended and bent position.
Figure 6:
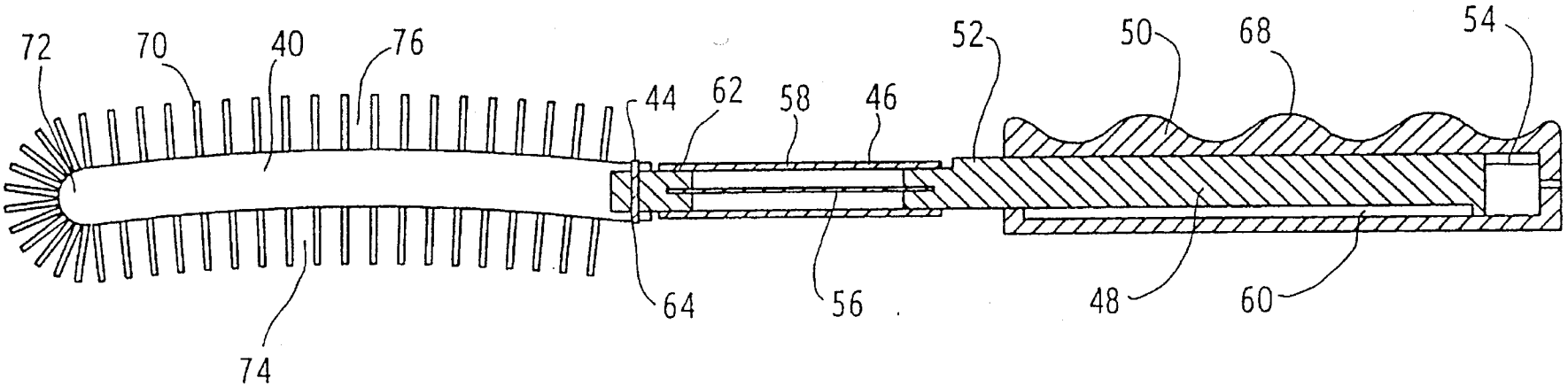
FIG. 6 shows a side view of the second embodiment in cross section.
Figure 7:
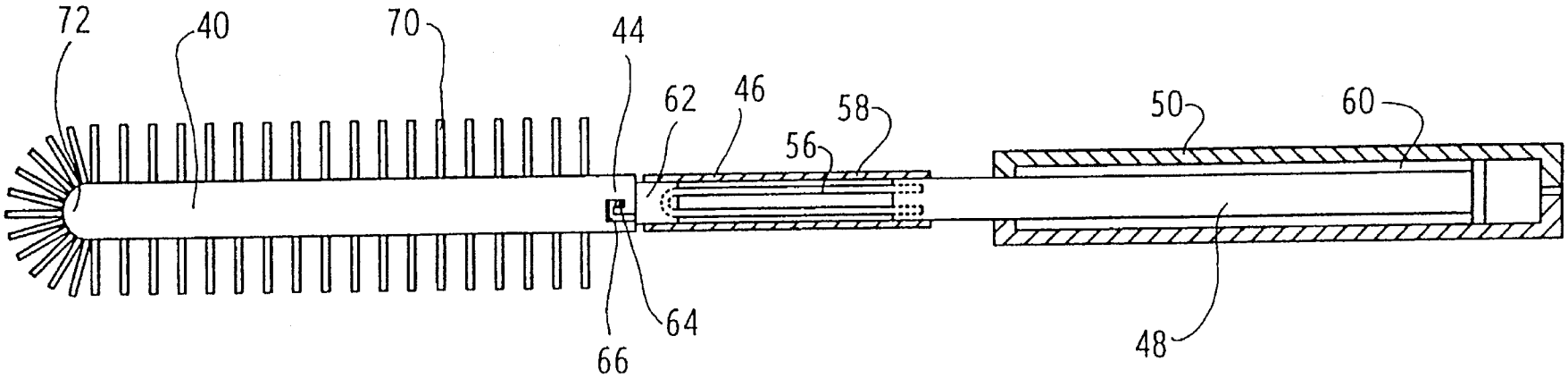
FIG. 7 shows a top view of the second embodiment in cross section.
Figure 15:
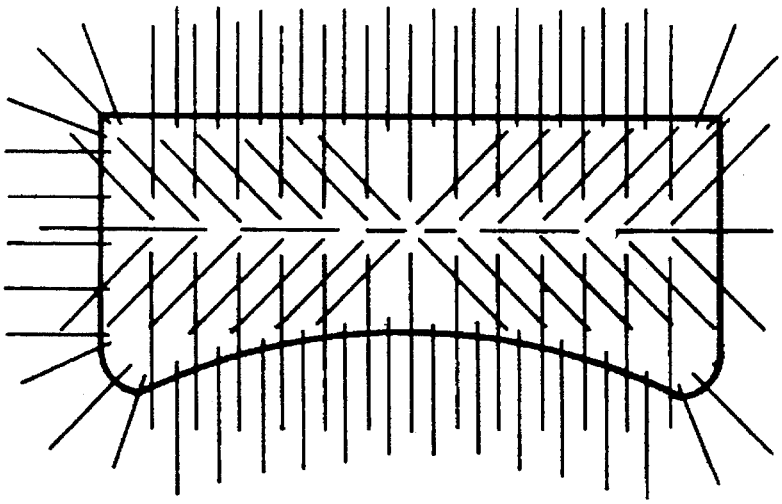
FIG. 15 shows a detachable brush head with one concave side and one flat side.
Figure 16:
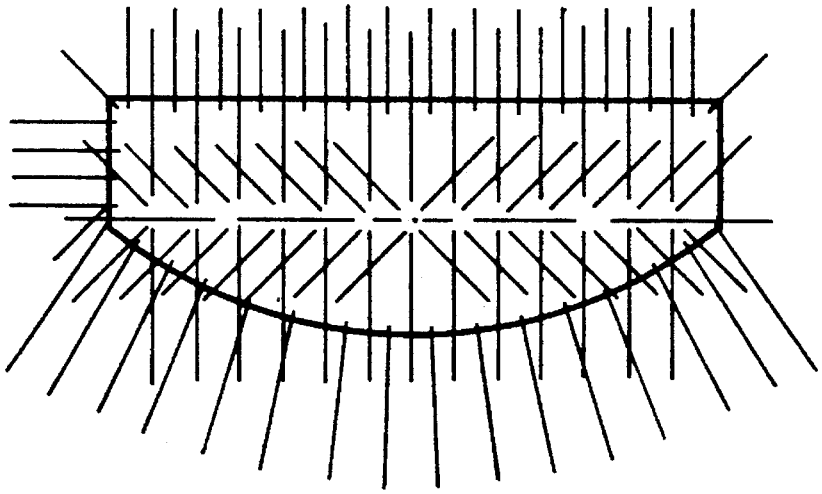
FIG. 16 shows a detachable brush head with one convex side and one flat side.

FIG. 5 shows this second embodiment with the telescoping extension 48 fully extended from the handle section 50 and the bendable section 46 slightly bent as if for brushing the hair on the back of the head. The handle 42 in this embodiment is shown as having a molded ergonomically shaped grip 68 on the handle section 50. The removable brush head 40 is shown as having a concave/convex curve shape with radially extending bristles 70. The bristles 70 extend from the brush head 40 in all directions, including the end of the 72 brush head 40. The concave/convex curve shape of the brush head 40 facilitates a number of hair styling techniques. The concave side 74 of the brush head 40 conforms to the side of the head for brushing the hair straight, while the convex side 76 side enhances shaping ability for styling. This embodiment may also be made with one flat side, i.e. flat/convex, (FIG. 16) flat/concave (FIG. 15).

Figure 8:
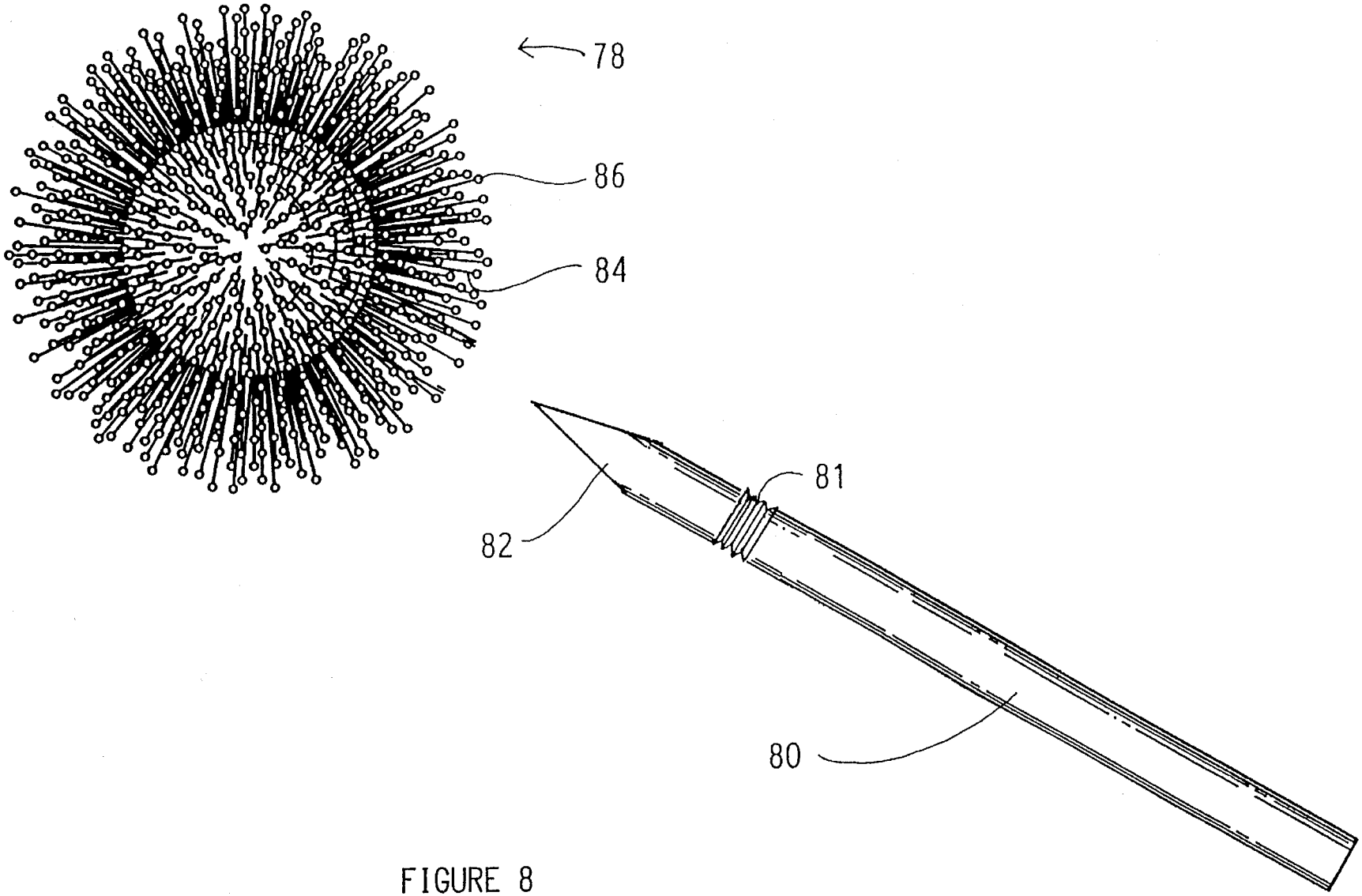
FIG. 8 shows a third embodiment that has a removable brush head with a bendable, detachable brush handle.

FIG. 8 shows a third embodiment of the present invention that has a removable brush head 78 and another style of bendable, detachable brush handle 80. The brush handle 80 has a tapered friction connector 82 on one end that fits into a tapered hole in the brush head 78 (seen in FIG. 10 as number 96). The brush handle 80 can be made bendable by making it of flexible plastic molded over a bending element similar to those described above. The detachable brush head 78 shown in FIG. 8 is a special ball-shaped brush head with radially extending bristles 84 with rounded ends 86 on the ends of the bristles 84. The detachable brush handle 80 has a bendable section 81 that allows the handle to be bent to any desired angle. The egg-shaped brush head 78 is especially useful for certain types of hair styling techniques. Because the brush head 78 has a smaller radius of curvature on one end compared to the other, it can be used more effectively for curling the hair with a blow dryer than standard hair brushes. To do this, the hair is wrapped around the brush head 78 with the end of the brush with the smaller radius closest to the head and the hair is dried with a blow dryer. The smaller radius on the end of the brush head 78 imparts more curve to the hair closest to the head where it is most needed.

Figure 9:
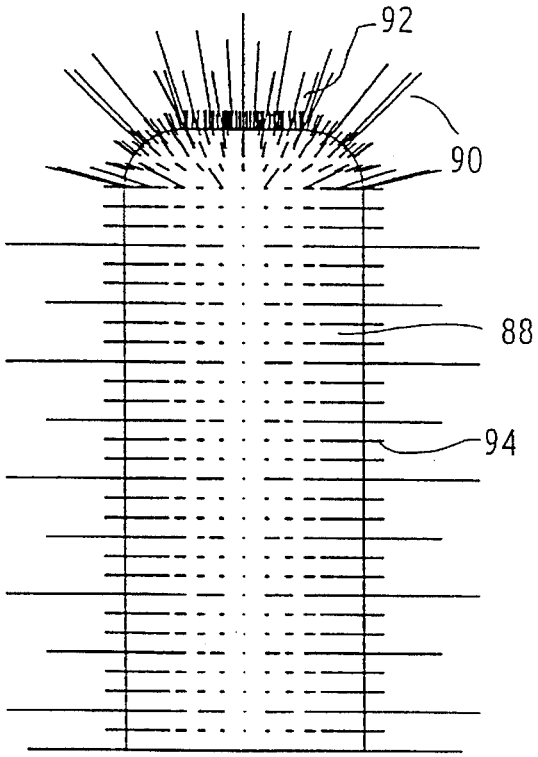
FIG. 9 shows a cylindrical detachable brush head.
Figure 10:
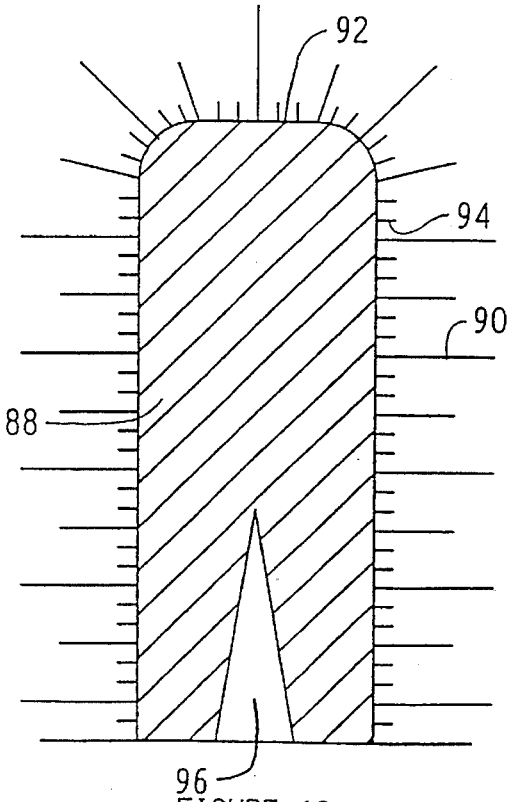
FIG. 10 shows the cylindrical detachable brush head in cross section.

FIGS. 9–14 show different types of brush heads that can be provided as part of the present invention. Each of the illustrated brush heads can be permanently attached to an extendable, bendable handle as in the first embodiment described above or they can be provided with a removable connector for detaching from the brush handle as in the second and third embodiments. FIG. 9 shows a cylindrical detachable brush head 88. The brush head 88 has bristles 90 extending radially in all directions, including from the end of the brush 92. This brush head also has a number of shorter, closely spaced bristles 94 that act as gripping elements for more gripping strength when brushing or curling the hair. FIG. 10 shows a cross section of this cylindrical brush head 88. This example is shown with a tapered hole 96 in the brush head 88 that fits onto the tapered friction connector 82 of the brush handle 80 in FIG. 8.

Figure 11:
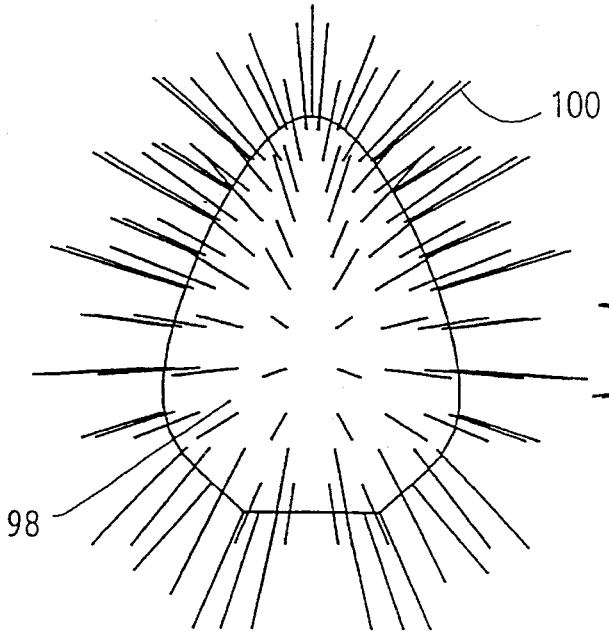
FIG. 11 shows an egg-shaped detachable brush head.
Figure 12:
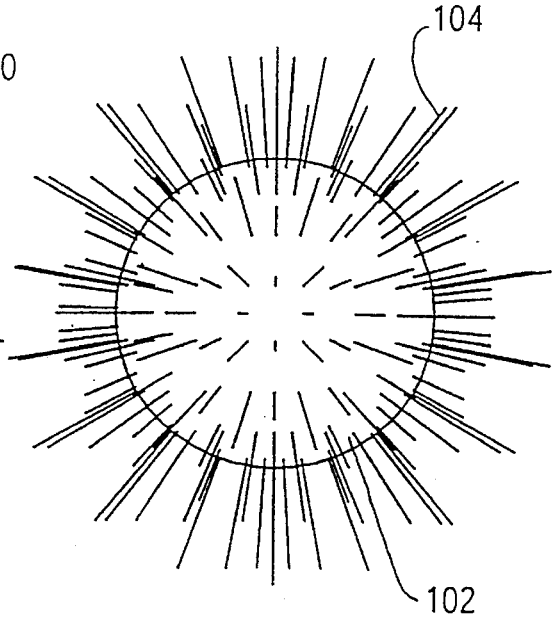
FIG. 12 shows a spherical detachable brush head.

FIG. 11 shows a brush head that has an egg-shaped body 98 with radially extending bristles 100. FIG. 12 shows a brush head that has a spherical body 102 with radially extending bristles 104. The spherical or ball-shaped brush head 102 can be made in different sizes and it is useful for a number of different hair styling techniques. One of the hair styling techniques that it is especially useful for is for flipping the ends of the hair under and curling them with a hair dryer. The technique is started at one side of the head by winding the hair around the head of the spherical brush and drying the hair with a blow dryer or the like. The spherical brush head is then rotated by twirling the attached handle to entrain the adjacent hair around the brush head and that section of the hair is dried. This technique is continued all the way around the head by twirling the brush without removing it from the hair. This technique is much easier and effective than prior art techniques using a cylindrical hairbrush because the cylindrical hairbrush has to be removed from the hair at each step when it is moved to a new part of the head which may undo part of the curl that has just been imparted to the hair. When the spherical brush head is used with the extendable handle, this entire technique can be done with the arms in a lower, more comfortable position than with short, rigid prior art brushes. Another feature which can enhance the effectiveness of the present invention when used with a hair dryer is that any or all of the embodiments of the brush can be made with a ventilated body with air passages that allow the hot air from the hair dryer to pass freely through the brush while styling.

Figure 13:
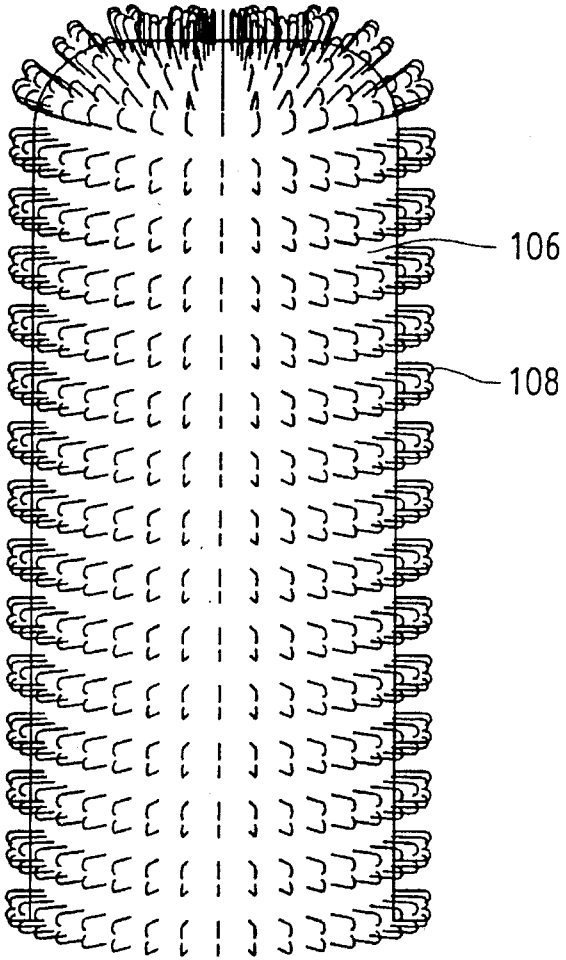
FIG. 13 shows a perspective view of a detachable hair curler attachment with gripping elements.

One of the objectives of the invention is also to provide an easy and convenient way to apply hair curlers to the hair. FIG. 13 shows a perspective view of a cylindrical curling attachment 106 for the hairbrush that has been made with tiny hook-shaped gripping elements 108 that are shaped like the hook portion of a hook and loop fastener. The cylindrical curling attachment 106 can be attached to any one of the brush handles that have been described and applied to the hair by turning the handle while the curling attachment 106 is in contact with the hair. The hook-shaped gripping elements 108 grip the hair and hold it to the curling attachment 106. Once the hair is wrapped around the curling attachment 106, the handle can be removed and the curling attachment 106 can be left in the hair. The hook-shaped gripping elements 108 hold the curling attachment 106 in the hair. No pins, clips or other fasteners are needed to hold the curling attachment 106 in place. The hairbrush can be supplied with a number of curling attachments 106 so that another curling attachment 106 can be attached to the handle and applied to the hair if desired. With the extendable or bendable handles described above, the curling attachments 106 can easily be applied to the top or back of the head with the arms in a lower, more comfortable position than using prior an hair curlers that do not have a detachable handle. Another advantage of the detachable handle is that it can be used for handling heated curlers and applying them to the hair without any danger of burning the hands with the hot hair curlers. When used as heated curlers, the brush head attachments can be made with metal parts to retain more heat to keep the curlers hot for a longer period of time.

Figure 14:
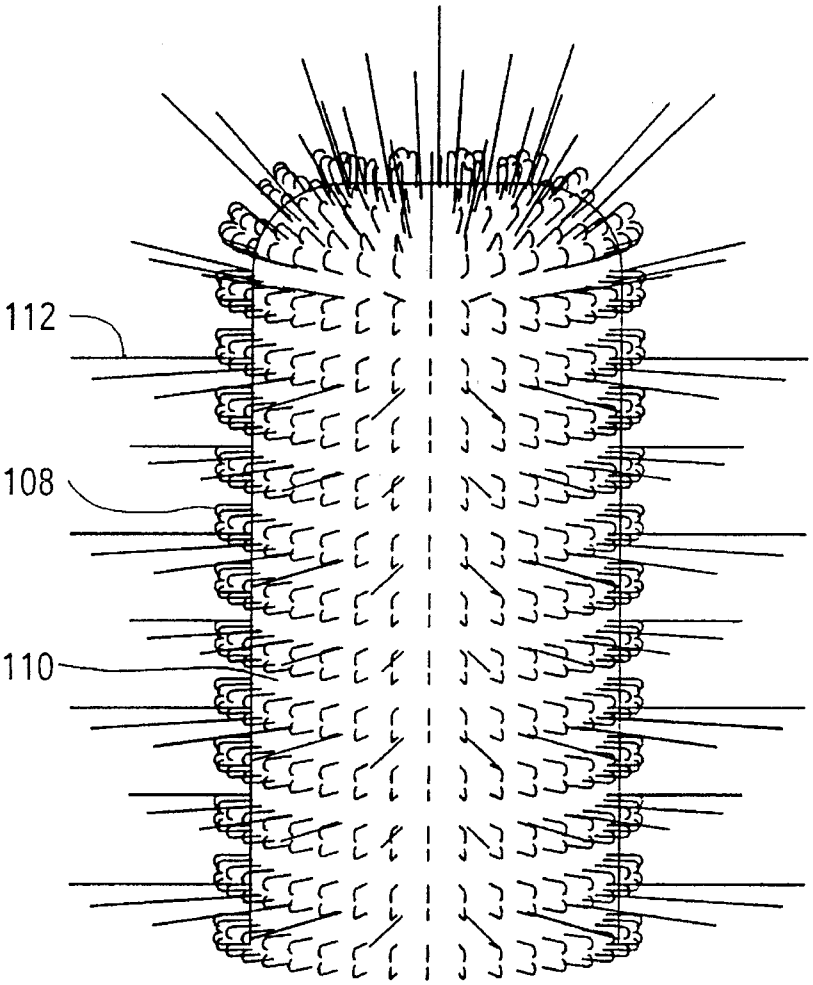
FIG. 14 shows a perspective view of a detachable brush head with gripping elements and bristles.
Figure 17:
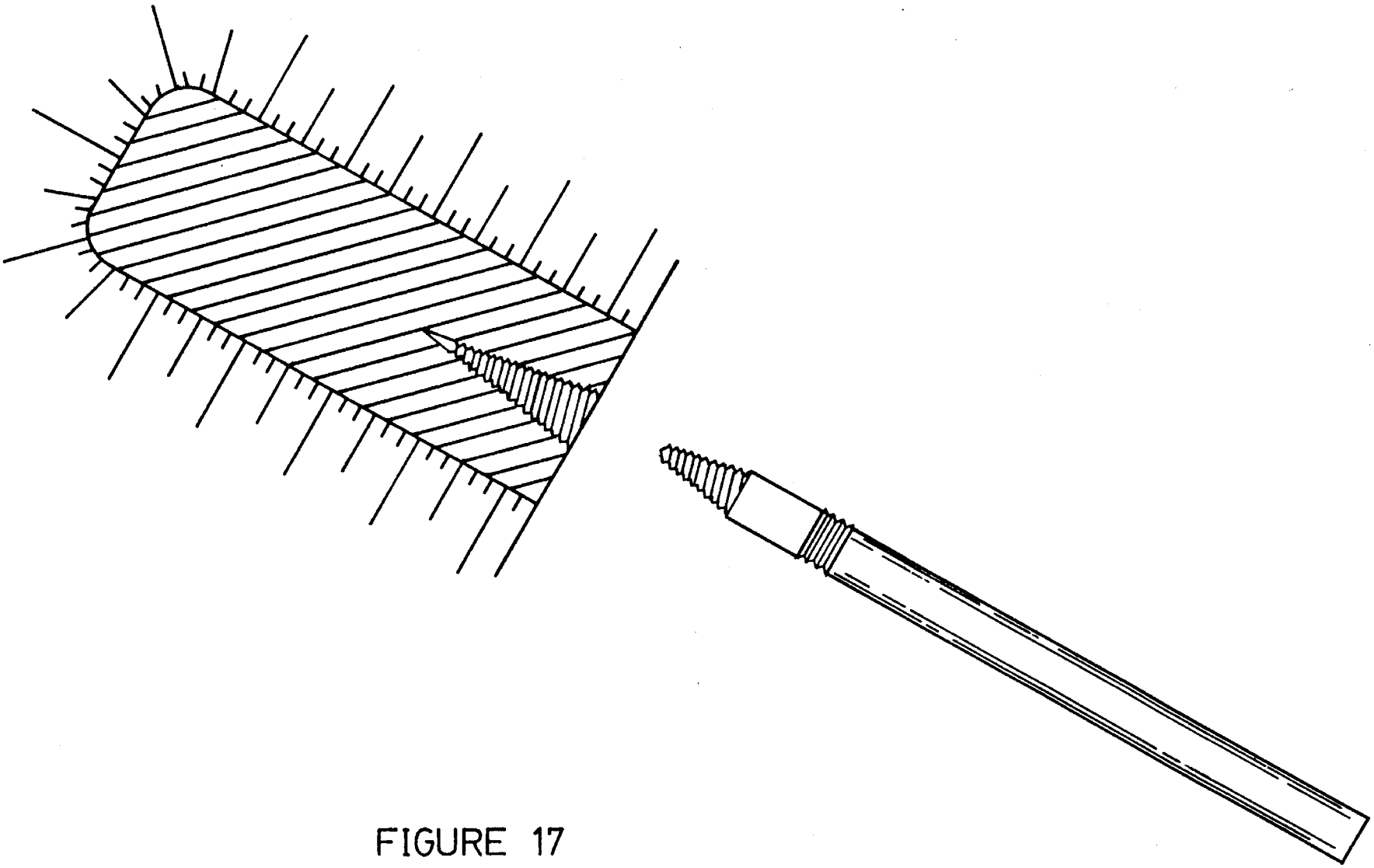
FIG. 17 shows a detachable brush head and brush handle with respective female and male threaded connectors.

FIG. 14 shows a perspective view of a detachable brush head 110 that combines the tiny hook-shaped gripping elements 108 gripping elements with standard brush bristles 112. This combination brush head 110 can be used for brushing or for curling the hair. When used for brushing the hook-shaped gripping elements 108 provide additional gripping power for brushing the hair. When it is used for hair curling, the added bristles 112 help to hold brush head 110 into the hair, especially if they are used for curling long hair. Once again, this detachable brush head 110 can be made with the bayonet connector of the second embodiment, the tapered friction connector of the third embodiment, the threaded connector of FIG. 17, or any other convenient detachable connector.

Although the examples given include many specificities, they are intended as illustrative of only some of the possible embodiments of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. A hair styling device comprising:

a handle section having an internal bore, an extension member slidingly received within said internal bore of said handle section, and a brush head attached to said extension member, wherein said extension member comprises a bendable section having a bendable element therein, said bendable element being flexible enough to allow said bendable section to be easily bent to a desired position and said bendable element being rigid enough to hold said bendable section in said desired position, whereby the length of said hairbrush can be contracted by sliding said extension member into said internal bore of said handle section, and the length of said hairbrush can be extended by withdrawing said extension member from said internal bore of said handle section.

2. The styling device of claim 1 wherein said bendable element comprises a metallic element which is made from a metal chosen from the group consisting of mild steel, aluminum, alloys of aluminum, copper, alloys of copper, lead, alloys of lead, tin and alloys of tin.

3. The styling device of claim 1 wherein said bendable element is made with a bending bias that allows said bendable element to be easily bent in a first direction but not easily bent in a second direction.

4. The styling device of claims 1 further compromising a detachable connection between said handle section and said brush head such that said brush head can be removed from said handle section.

5. The styling device of claims 4 wherein said detachable connection comprises a connector selected from the group consisting of a bayonet connector, a friction connector, a tapered friction connector and a threaded connector.

6. The styling device of claims 1 wherein said extension member comprises a key and said handle section comprises a keyway which slidingly engages said key such that said extension member is prevented from rotating with respect to said handle section.

7. The styling device of claims 1 wherein said brush head is of a shape selected from the group consisting of a sphere, an egg shape, a cylinder, a shape with one convex side and one concave side, a shape with one convex side and one flat side, and a shape with one concave side and one flat side.

8. The styling device of claims 1 wherein said brush head comprises a multiplicity of minute hook-shaped gripping elements.

9. A hair styling device comprising:

a handle section;

a brush head; and an extension member connected between said brush head and said handle section, said extension member comprising a bendable section having a bendable element therein, said bendable element being flexible enough to allow said bendable section to be easily bent to a desired position and said bendable element being rigid enough to hold said bendable section in said desired position.

10. The styling device of claim 9 wherein said bendable element comprises a metallic element which is made from a metal chosen from the group consisting of mild steel, aluminum, alloys of aluminum, copper, alloys of copper, lead, alloys of lead, tin and alloys of tin.

11. The styling device of claim 9 wherein said bendable element is made with a bending bias that allows said bendable element to be easily bent in a first direction but not easily bent in a second direction.

12. The styling device of claim 9 further compromising a detachable connection between said extension member and said brush head such that said brush head can be removed from said extension member.

13. The styling device of claim 9 wherein said brush head is of a shape selected from the group consisting of a sphere, an egg shape, a cylinder, a shape with one convex side and one concave side, a shape with one convex side and one flat side, and a shape with one concave side and one flat side.

14. The styling device of claim 12 wherein said brush head comprises a multiplicity of minute hook-shaped gripping elements.

15. A hair styling device comprising:

a handle section;

an extension member having a first distal end portion and a second distal end portion, said handle section being connected to said first distal end portion;

a brush head removably attached to said second distal end portion, said brush head including a multiplicity of minute hook-shaped gripping elements;

wherein said brush head includes at least one thermally conductive means for allowing said brush head to function as a heated curler.

16. The styling device of claim 15 further compromising a detachable connection between said extension member and said brush head such that said brush head can be removed from said extension member, wherein said detachable connection comprises a connector selected from the group consisting of a bayonet connector, a friction connector, a tapered friction connector and a threaded connector.

17. The styling device of claim 15 wherein said brush head is of a shape selected from the group consisting of a sphere, an egg shape, a cylinder, a shape with one convex side and one concave side, a shape with one convex side and one flat side, and a shape with one concave side and one flat side.

18. A hairbrush comprising:

a handle section, and a brush head attached to said handle section, said brush head having a body with a shape selected from the group consisting of an egg shape, and a cylindrical shape having a hemispherical end, said hemispherical end including a portion of said multiplicity of bristles radiating therefrom.

19. The hairbrush of claim 18 wherein said brush head has an egg shape.

20. The hairbrush of claim 18 wherein said brush head has a cylindrical shape having a hemispherical end, said hemispherical end including a portion of said multiplicity of bristles radiating therefrom.

21. The styling device of claim 18 wherein said brush head comprises a multiplicity of minute hook-shaped gripping elements.

* * * * *